US006736656B1

(12) United States Patent
Yu

(10) Patent No.: US 6,736,656 B1
(45) Date of Patent: May 18, 2004

(54) ELECTRICAL CARD CONNECTOR

(75) Inventor: Hung-Chi Yu, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/329,177

(22) Filed: Dec. 23, 2002

(30) Foreign Application Priority Data

Dec. 10, 2002 (TW) ..... 91219996

(51) Int. Cl.[7] ..... H01R 13/62

(52) U.S. Cl. ..... 439/159; 439/892; 439/893; 439/97; 411/372.5; 411/372.6

(58) Field of Search ..... 439/159, 892, 439/893, 367, 521, 522, 573, 97; 411/372.5, 372.6

(56) References Cited

U.S. PATENT DOCUMENTS 6,135,691 A * 10/2000 Nadarajah et al. ..... 411/431
6,196,637 B1 * 3/2001 Hou et al. ..... 301/37.375
6,231,382 B1 * 5/2001 Yu ..... 439/541.5
6,267,421 B1 * 7/2001 Burton ..... 292/340

OTHER PUBLICATIONS

Two drawings showing the prior art known to the applicant.

* cited by examiner

*Primary Examiner*—Tho D. Ta
(74) *Attorney, Agent, or Firm*—Wei Te Chung

(57) ABSTRACT

An electrical card connector (1) mounted on a printed circuit board (2) via a bolt (3) includes an insulating body (10) in which a number of terminals (11) are provided for electrical connection to the printed circuit board, a shield (12) covering the insulating body, a pair of stand-off devices (14) secured on opposite sides of the shield and a pair of shield members (15) attached on the stand-off devices. Each stand-off device includes a retention portion (140) secured to the shield and a terminal portion (141) with a screw hole (1412) defined therein extending laterally from a lower edge of the retention portion for connection to the printed circuit board. The shield member defines a round hole (151) aligned with the screw hole for receiving therein a tail portion (31) of the bolt.

6 Claims, 4 Drawing Sheets

ELECTRICAL CARD CONNECTOR

BACKGROUND OF THE INVENTION

1. Field of the Invention

The present invention relates to an electrical card connector having a stand-off device, and particularly to an electrical card connector which can shield a fastener, which is employed to mount the stand-off device to a printed circuit board, from interfering other electronic devices. This application relates to the other two contemporaneously filed applications having the same title, the same inventor and the same assignee with the invention.

2. Description of Related Art

Electrical card connectors, such as PCMCIA (Personal Computer Memory Card international Association) card connectors, are widely used in computer industry for electrically connecting with inserted electronic cards which function as removable mass storage devices. To meet the trend of miniaturization and high-speed data transmission of computer technology, the electrical card connectors are developed to have a compact and high-density arrangement regarding contacts of the electrical card connectors, which may result in. EMI (Electromagnetic Interference) and ESD (Electro-static Discharge) problems, thereby adversely affecting electrical performance of the electrical card connectors.

In order to achieve better electrical performance, the electrical card connectors are equipped with grounding devices to ground the inserted electronic cards to a ground circuit of a printed circuit board on which the connectors are mounted. At the same time, the electrical card connectors often have stand-off devices for providing clearance between the connectors and the printed circuit board to thereby allowing components such as semiconductors to be mounted on the printed circuit board below the card connectors. Generally, the stand-off devices of the electrical card connectors also have grounding function. Thus, no additional grounding devices are required for the electrical card connectors. Examples of these conventional electrical card connectors are disclosed in U.S. Pat. Nos. 6,069,633, 6,231,382, 6,059,586 and 6,048,214.

A conventional electrical card connector 4 and a printed circuit board on which the connector 4 is mounted are presented. The electrical connector 4 comprises an insulating body in which a plurality of terminals are provided for electrical connection to the printed circuit board, a shield covering the insulating body and a pair of stand-off devices 44 attached to the shield on opposite sides thereof. Each stand-off device is generally of an L-shaped configuration including a retention portion and a terminal portion extending perpendicularly from a lower edge of the retention portion. The retention portion defines a first and a second slits (not labeled) for fitly receiving therein a first spring tab and a second spring tab of the shield, respectively, whereby the stand-off device is securely attached to the shield. The terminal portion has a projection defining a screw hole therein. A bolt is employed to upwardly extend through a positioning hole of the printed circuit board and then into the screw hole of the stand-off device, thereby fixing the connector 4 on the printed circuit board. It is noted that the terminal portion is also connected to a ground circuit of the printed circuit board for grounding purpose.

The bolt generally has a large lengthwise dimension for fixing the electrical card connector 4 to the printed circuit boards having various thickness. When the printed circuit board is thinner, a tail portion of the bolt extends beyond the projection and is mostly exposed above the printed circuit board. The exposed tail portion of the bolt has a risk of interfering other electronic devices, whereby a connection is easy to become loose between the connector 4 and the printed circuit board, which results in an unreliable electrical connection between the connector 4 and the printed circuit board. At the same time, the exposed tail portion of the bolt may scratch or even damage the electronic devices, thereby increasing the manufacturing cost.

SUMMARY OF THE INVENTION

Accordingly, it is an object of the present invention to provide an electrical card connector having a stand-off device, the connector being configured to prevent a fastener, which is employed to mount the stand-off device to a printed circuit board, from interfering other electronic devices.

In order to achieve the object set forth, an electrical card connector in accordance with the present invention comprises an insulating body in which a plurality of terminals are provided for electrical connection to a printed circuit board, a shield covering the insulating body, a pair of stand-off devices secured on opposite sides of the shield and a pair of shield members attached on the stand-off devices. Each stand-off device includes a retention portion secured to the shield and a terminal portion with a screw hole defined therein extending laterally from a lower edge of the retention portion for connection to the printed circuit board. The shield member defines a round hole aligned with the screw hole for receiving therein a tail portion of the bolt, thereby shielding the bolt from interfering other electric devices.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
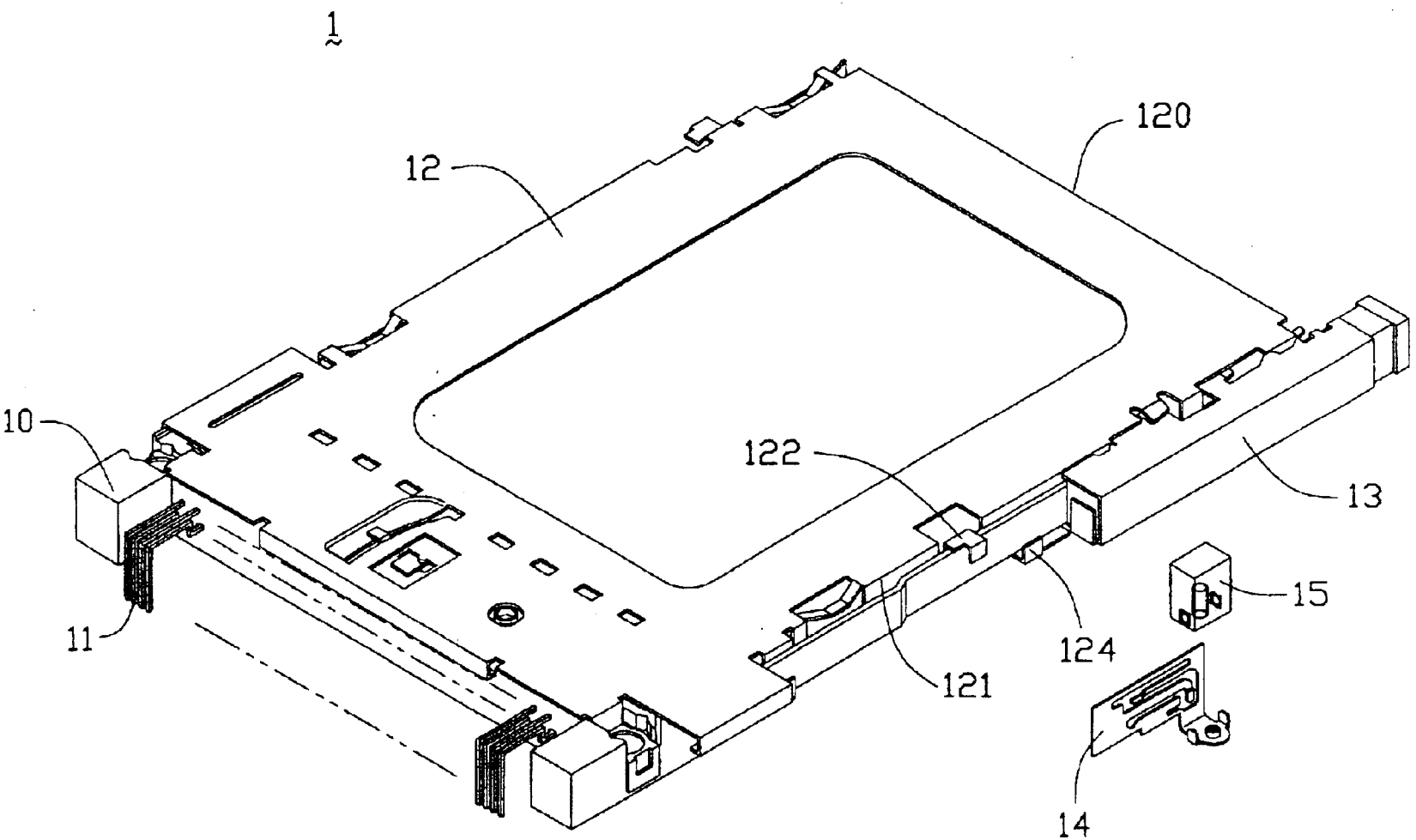
FIG. 1 is a partially exploded, perspective view of an electrical card connector in accordance with the present invention.
Figure 2:
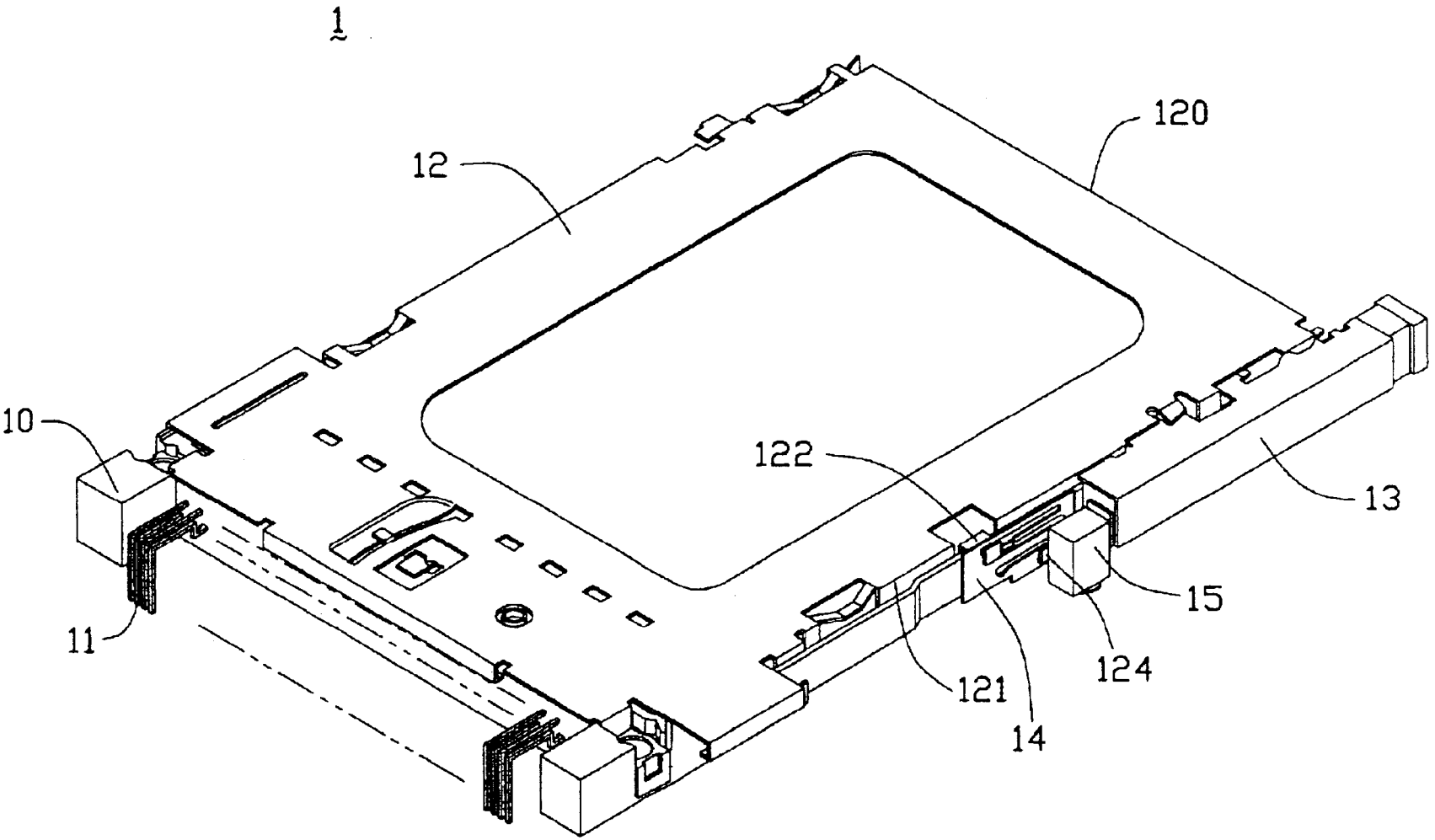
FIG. 2 is an assembled view of the electrical card connector of FIG. 1.

Referring to FIGS. 1 and 2, an electrical card connector 1 in accordance with the present invention comprises an insulating body 10 in which a plurality of terminals 11 are provided for electrical connection with an electronic card (not shown) and a printed circuit board 2 (FIG. 4), a shield 12 covering the insulating body 10, an ejector 13 attached to one side of the shield 12 for ejecting the inserted electronic card therefrom, a pair of stand-off devices 14 (only one is shown) secured on opposite sides of the shield 12 and a pair of shield members 15 (only one is shown) attached on the stand-off devices 14. The shield 12 includes a plate 120 and a pair of side walls 121 extending downwardly perpendicularly from opposite ends of the plate 120 to form a receiving space (not shown) therebetween for receiving the electronic card therein. Each side wall 121 of the shield 12 forms a first and a second spring tabs 122, 124 therein.

Figure 3:
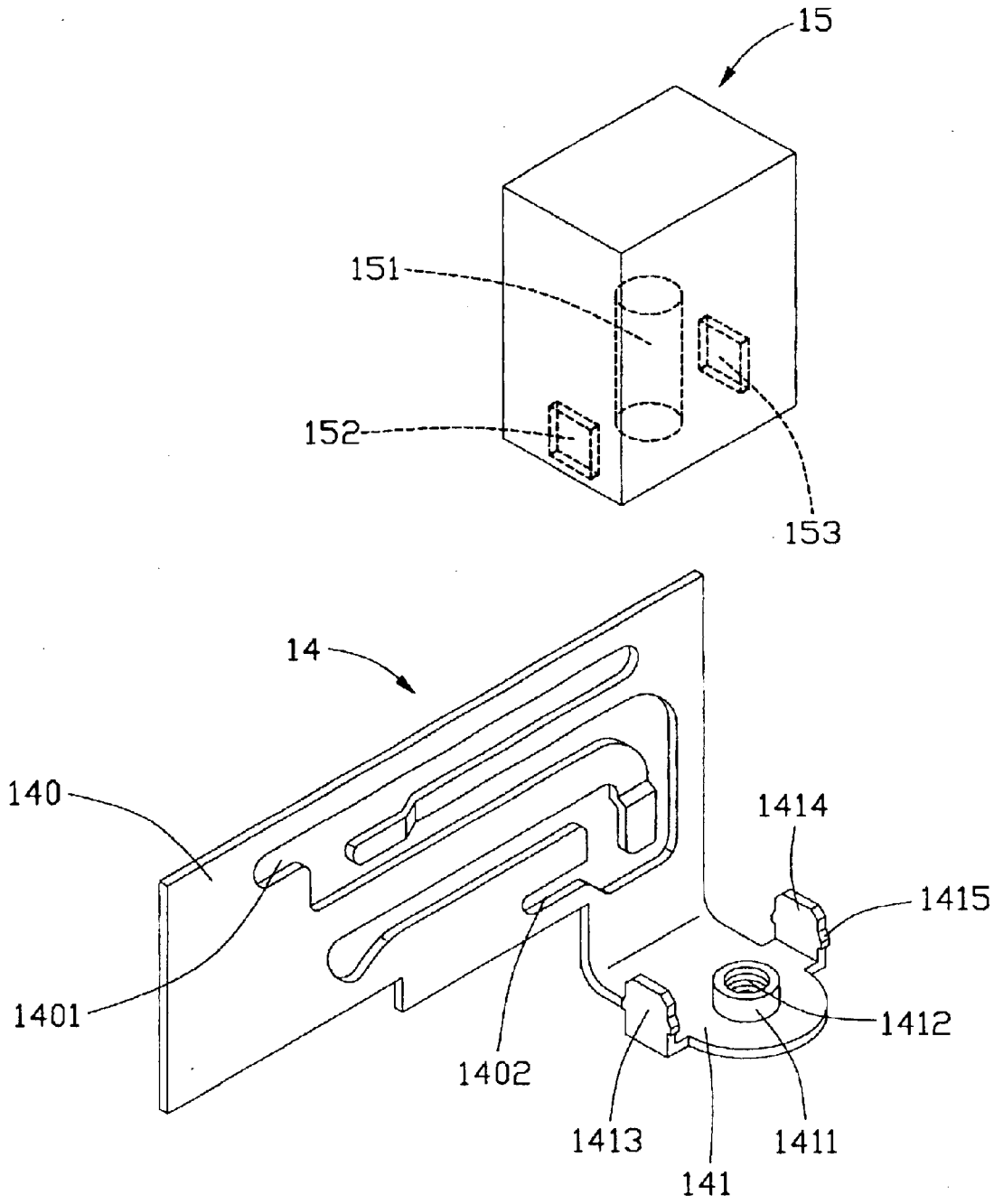
FIG. 3 is an enlarged perspective view of a stand-off device and a shield member shown in FIG. 1.

Referring to FIG. 3, the stand-off device 14 is generally of an L-shaped configuration including a retention portion 140 secured to the shield 12 and a terminal portion 141 extending perpendicularly from a lower edge of the retention portion 140 for connection to the printed circuit board 2. The retention portion 140 defines a first and a second lock holes 1401, 1402 respectively for receiving and retaining the first and the second spring tabs 122, 124 therein, thereby securing the stand-off devices 14 on the side walls 121 of the shield 12. The terminal portion 141 has a projection 1411 with a screw hole 1412 defined therein for engaging with a bolt 3 (FIG. 4) and a pair of tongues 1413, 1414 each having barbs 1415 thereon extending from edges of the terminal portion 141.

The shield member 15 is made of insulating material and generally of a rectangular configuration. The shield member 15 defines a round hole 151 aligned with the screw hole 1412 and a pair of slits 152, 153 on opposite sides of the round hole 151 to have an interferential engagement with the pair of tongues 1413, 1414, thereby retaining the shield member 15 on the stand-off device 14.

Figure 4:
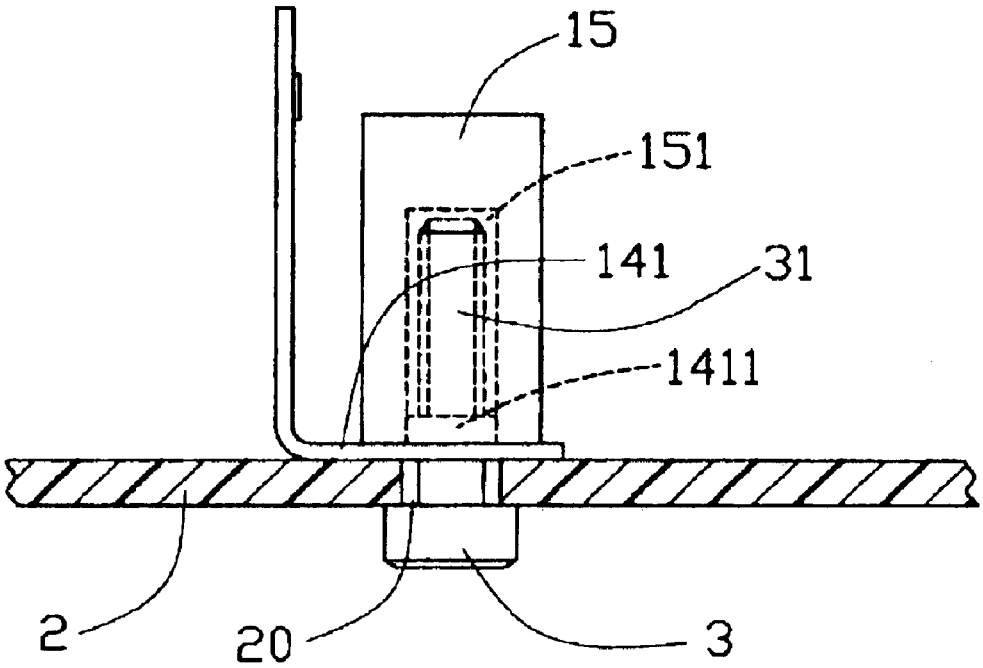
FIG. 4 is a plan view schematically showing the stand-off device of the electrical card connector mounted on a printed circuit board.

Referring to FIG. 4 in conjunction with FIG. 3, the printed circuit board 2 defines a positioning hole 20 corresponding to the screw hole 1412 of the stand-off device 14. When the electrical card connector 1 is mounted on the printed circuit board 2, the screw hole 1412 is aligned with the positioning hole 20 and the bolt 3 upwardly extends through the positioning hole 20 from a bottom of the printed circuit board 2 and then engages with the screw hole 1412 of the stand-off device 14. A tail portion 31 of the bolt 3 extends beyond the projection 1411 to be received in the round hole 151 of the shield member 15, thereby preventing the tail portion 31 of the bolt 3 from interfering other electronic devices to ensure reliable working of the electrical card connector 1 and other electronic devices.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector mounted on a printed circuit board via a bolt, comprising:

an insulating body in which a plurality of terminals are provided for electrical connection to the printed circuit board;

a shield covering the insulating body;

a stand-off device including a retention portion secured to the shield and a terminal portion extending laterally from a lower edge of the retention portion for connection to the printed circuit board, the terminal portion defining a first hole for engaging with the bolt; and a shield member attached on the stand-off device and defining a second hole aligned with the first hole for receiving therein a tail portion of the bolt;

wherein the terminal portion has a tongue extending upwardly therefrom, and the shield member defines a slit for interferentially receiving the tongue therein;

wherein the terminal portion has a projection extending toward the shield member, and the first hole is defined in the protection;

wherein the first hole is a screw hole.

2. The electrical card connector as claimed in claim 1, wherein the shield defines a spring tab, and the retention portion of the stand-off device defines a lock hole for receiving and retaining the spring tab therein.

3. An electrical connector assembly comprising:

a printed circuit board defining opposite upper and bottom surfaces with a through hole extending therethrough;

an electrical connector mounted upon the upper surface of the printed circuit board, said connector including an insulative housing assembly with a plurality of contacts therein;

a metal shield assembly enclosing at least partially the housing assembly;

a metal standoff secured to at least one of said housing assembly and said shield assembly, said standoff including a mounting plate seated upon the upper surface of the printed circuit board with therein a screw hole substantially located outside of an outer contour of said connector while in alignment with said through hole; and a screw extending upwardly from the bottom surface of said printed circuit board through both the through hole and the screw hole and above said mounting plate with a head section of said screw located on the bottom surface of the mother board; wherein said connector is equipped with a dielectric cover device shielding a portion of the screw above the mounting plate;

wherein said dielectric cover device is associated with the standoff;

wherein said dielectric cover is defined with therein a hole receiving said Portion of the screw;

wherein the mounting plate has a tongue extending upwardly therefrom, and the dielectric cover device defines a slit for interferentially receiving the tongue therein.

4. The assembly as claimed in claim 3, wherein said shield assembly defines two sides of the connector.

5. The assembly as claimed in claim 3, wherein said standoff is secured to the shielding assembly.

6. The assembly as claimed in claim 3, wherein said shield assembly is further equipped with an ejection mechanism.

* * * * *